US009166319B2

(12) United States Patent
Gingrich, III et al.

(10) Patent No.: US 9,166,319 B2
(45) Date of Patent: Oct. 20, 2015

(54) FLEXIBLE CIRCUIT BOARD CONNECTOR

(71) Applicant: Tyco Electronics Corporation, Berwyn, PA (US)

(72) Inventors: Charles Raymond Gingrich, III, Mechanicsburg, PA (US); Matthew Edward Mostoller, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 6 days.

(21) Appl. No.: 14/056,316

(22) Filed: Oct. 17, 2013

(65) Prior Publication Data

US 2015/0111410 A1 Apr. 23, 2015

(51) Int. Cl.

| | |
|---|---|
| ***H01R 12/77*** | (2011.01) |
| ***H01R 12/62*** | (2011.01) |
| ***H01R 13/506*** | (2006.01) |
| ***H01R 12/79*** | (2011.01) |
| ***H01R 13/24*** | (2006.01) |
| *H01R 12/70* | (2011.01) |
| *H01R 13/627* | (2006.01) |
| *H01R 13/629* | (2006.01) |
| *H01R 12/72* | (2011.01) |
| *H01R 12/50* | (2011.01) |

(52) U.S. Cl.

CPC ..... *H01R 12/778* (2013.01); *H01R 12/771* (2013.01); *H01R 13/24* (2013.01); *H01R 12/62* (2013.01); *H01R 12/7011* (2013.01); *H01R 12/721* (2013.01); *H01R 12/777* (2013.01); *H01R 12/79* (2013.01); *H01R 13/506* (2013.01); *H01R 13/627* (2013.01); *H01R 13/62988* (2013.01); *H01R 23/722* (2013.01)

(58) Field of Classification Search

CPC .... H01R 13/627; H01R 23/722; H01R 12/79; H01R 12/721; H01R 12/62; H01R 12/7011; H01R 13/62988

USPC ..... 439/492, 494, 499, 495, 493, 329

See application file for complete search history.

(56) References Cited

U.S. PATENT DOCUMENTS

| | | | | |
|---|---|---|---|---|
| 4,235,500 | A * | 11/1980 | Belopavlovich et al. | 439/495 |
| 6,042,410 | A | 3/2000 | Watanabe | |
| 7,255,594 | B2 * | 8/2007 | Huang et al. | 439/495 |
| 2005/0260885 | A1 * | 11/2005 | Lu | 439/495 |
| 2007/0099480 | A1 * | 5/2007 | Fabian et al. | 439/441 |
| 2008/0305651 | A1 * | 12/2008 | Mostoller et al. | 439/62 |

OTHER PUBLICATIONS

European Search Report, Mail Date, Mar. 19, 2015, EP 14 18 8821, Application No. 14188821.4-1801.

* cited by examiner

*Primary Examiner* — Abdullah Riyami
*Assistant Examiner* — Justin Kratt

(57) ABSTRACT

A flexible circuit board connector includes a contact having a separable mating interface mounted to a contact pad of a flexible circuit board and a terminating end terminated to a wire. A housing holds the contact and has a main body including a wire barrel configured to receive the wire. A clip is coupled to the housing with an intermediate space between the clip and the main body. The clip is movable between an open position and a closed position. The intermediate space is configured to receive the flexible circuit board when the clip is in the open position, and the clip and housing are configured to capture the flexible circuit board when the clip is in the closed position. The spring beam is configured to be electrically connected to the contact pad when the clip is in the closed position.

19 Claims, 6 Drawing Sheets

FLEXIBLE CIRCUIT BOARD CONNECTOR

BACKGROUND OF THE INVENTION

The subject matter herein relates generally to flexible circuit board connectors.

Flexible circuit boards or "flex circuits" have many applications. The flexible circuit boards are typically connected to connectors or headers the are mounted to rigid printed circuit boards. The rigid printed circuit boards supply power to the connector and the power is supplied from the connector to the flexible circuit board. There is a desire to use flex circuits in applications that do not lend themselves to connection to a rigid circuit board. The rigid circuit board adds cost to the overall system and are unnecessary. There is a need to connect wires directly to the flexible circuit boards and eliminate the rigid circuit board altogether. For example, in some lighting applications where LEDs are mounted on the flexible circuit boards, there is a need for electrically connecting wires to the flexible circuit board to power the flexible circuit board. The flexible circuit boards may be mounted to any mounting surface, such as under cabinets for under cabinet lighting. Connection of wires to the flexible circuit board can reduce the cost for certain applications, such as under cabinet lighting. However, soldering of wires to the flexible circuit board is difficult and may require special tools and expertise.

A need remains for a cost effective and reliable system for connecting wires to flexible circuit boards.

BRIEF DESCRIPTION OF THE INVENTION

In one embodiment, a flexible circuit board connector is provided including a contact having a mating end and a terminating end with the mating end having a spring beam having a separable mating interface configured to be surface mounted to a contact pad of a flexible circuit board and with the terminating end being configured to be terminated to a wire. A housing holds the contact and has a main body including a contact channel holding the contact and a wire barrel configured to receive the wire. The main body is positionable above the flexible circuit board such that the contact is aligned with the contact pad. A clip is coupled to the housing with an intermediate space between the clip and the main body. The clip is movable between an open position and a closed position. The intermediate space is configured to receive the flexible circuit board when the clip is in the open position, and the clip and housing are configured to capture the flexible circuit board when the clip is in the closed position. The spring beam is configured to be electrically connected to the contact pad when the clip is in the closed position.

Optionally, the contact may define a direct electrical path between the wire and the contact pad of the flexible circuit board. The contact may be a poke-in contact having a lance that mechanically and electrically connects to the wire. The housing may be pressed against the flexible circuit board and the contact may be compressed against the contact pad and held there by the clip when the clip is in the closed position.

Optionally, the clip may include a base. The intermediate space may be defined between the base and a bottom of the main body of the housing. The clip may engage the main body and press the main body toward the base to capture the flexible circuit board in the intermediate space.

Optionally, the clip may include a base and a cover. The housing may be received in the cover. At least one of the base or the cover may include latches to secure the base to the cover with the flexible circuit board captured between the main body and the base. Optionally, the cover may be hingedly coupled to the base at a hinge.

Optionally, the clip may include a base and latching beams extending from the base. The latching beams may latchably engage the housing to secure the housing to the clip. The housing may include lower grooves and upper grooves. When the latching beams are received in the lower grooves, the latching beams may hold the housing in a pre-staged position wherein the flexible circuit board is configured to be unobstructedly received in the intermediate space. When the latching beams are received in the upper groves, the latching beams may press the housing against the flexible circuit board to electrically connect the contact to the contact pad of the flexible circuit board.

Optionally, the housing may include a cap and a base hingedly coupled to the cap. The cap may be closed to capture the flexible circuit board between the cap and the base. The clip may be slidably coupled to the housing. The clip may be slid forward to the closed position to secure the base in a closed position.

Optionally, the clip may include a mounting tab extending therefrom. The mounting tab may be secured to a mounting surface. The mounting tab may extend along, such as under, the flexible circuit board. Optionally, the housing and/or the clip may include fingers configured to extend through the flexible circuit board to secure the flexible circuit board connector to the flexible circuit board.

In another embodiment, a flexible circuit board connector system is provided that includes a flexible circuit board having a front side and a rear side. The rear side is configured to be mounted to a mounting surface. The front side has a contact pad. The flexible circuit board has an LED terminated to the front side and electrically connected to the contact pad. A flexible circuit board connector is coupled directly to the flexible circuit board. The flexible circuit board connector includes a contact having a mating end and a terminating end. The mating end has a spring beam having a separable mating interface surface mounted to the contact pad of the flexible circuit board. The terminating end is terminated to a wire. A housing holds the contact and has a main body including a contact channel holding the contact and a wire barrel that receives the wire. The main body has a bottom and is positioned above the flexible circuit board such that the bottom engages the flexible circuit and the contact engages the contact pad. A clip is coupled to the housing with an intermediate space between the clip and the main body. The flexible circuit board is held in the intermediate space.

DETAILED DESCRIPTION OF THE INVENTION

Figure 1:
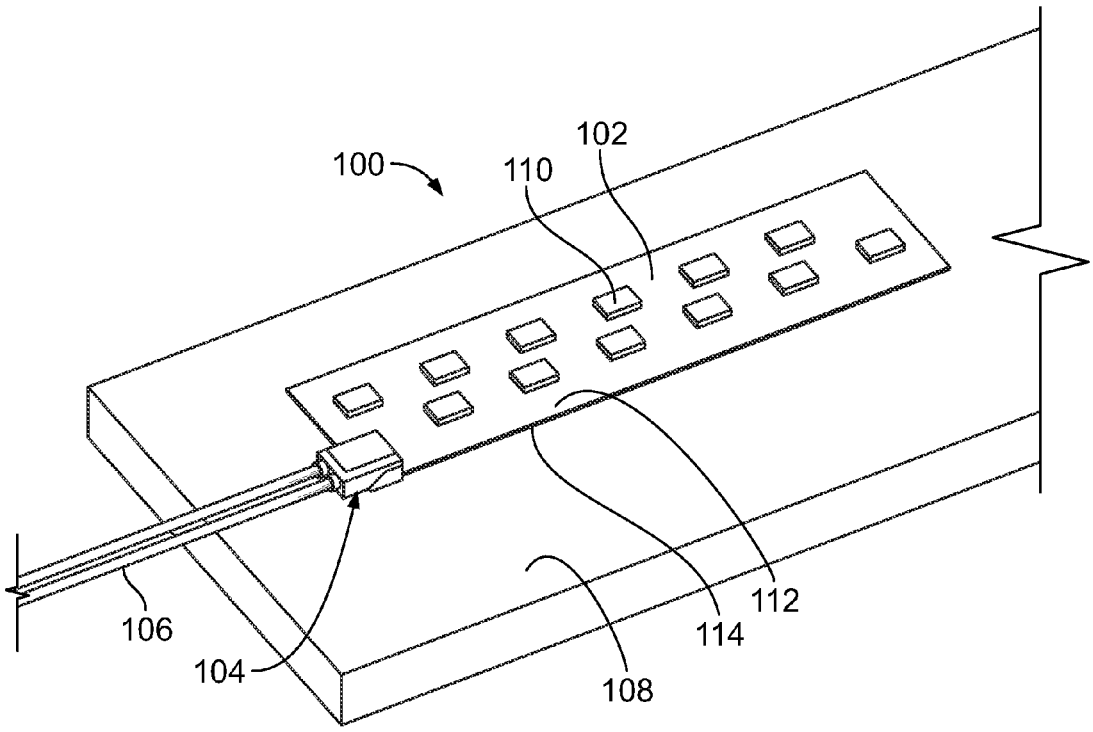
FIG. 1 is a front perspective view of a flexible circuit board connector system including a flexible circuit board connector formed in accordance with one embodiment.

FIG. 1 is a front perspective view of a flexible circuit board connector system 100 formed in accordance with one embodiment. The connector system 100 includes a flexible circuit board 102, also referred to as a flex circuit 102, and a flexible circuit board connector 104, or simply connector 104, electrically coupled to the flex circuit 102. Cables or wires 106 are directly terminated to the connector 104 and the connector 104 is used to electrically connect the wires 106 with the flex circuit 102. Power, for example, may thus be supplied directly from the wires 106 to the flex circuit 102 by the connector 104. The flex circuit 102 is configured to be mounted to a mounting surface 108. The mounting surface 108 may be planar, or alternative may be non-planar, such as a curved surface. The mounting surface 108 may be any type of mounting surface, such as an underside of a cabinet for under cabinet lighting.

In an exemplary embodiment, the connector 104 is a poke-in type of connector, where the wires 106 are coupled to the connector 104 by a simple poke-in wire termination. The poke-in termination offers quick and reliable wire termination as a low-labor alternative to hand-soldering of the wires 106 either directly to the flex circuit 102 or to a contact or other component.

In an exemplary embodiment, the connector system 100 may be part of a lighting system, such as an LED lighting system. For example, one or more LEDs 110 may be mounted to the flex circuit 102. The connector 104 may be electrically connected to the LEDs 110 by traces on the flex circuit 102. The connector 104 supplies power and/or control functions to the LEDs 110. The wire 106 supplies power and/or control signals to the connector 104. The connector system 100 may have use in other fields or for other applications in alternative embodiments other than supplying power to LEDs.

The flex circuit 102 includes a front side 112 and a rear side 114. The LEDs 110 are provided along the front side 112, but may be provided along the rear side 114 in addition or in the alternative to the front side 112. The rear side 114 may be secured to the mounting surface 108, such as using an adhesive layer, such as double sided tape. Optionally, the front side 112 may be upward facing and the rear side 114 may be downward facing; however other orientations are possible in alternative embodiments. The flex circuit 102 may be secured by other means, including fasteners, clips and the like in alternative embodiments. The flex circuit 102 is a substantially flat supporting layer that may mechanically support the connector 104 and may electrically connect the connector 104 with one or more peripheral devices, including the LEDs 110 via the traces. Optionally, the flex circuit 102 may be mounted to a heat sink to dissipate heat from the LEDs 110.

The connector 104 is mechanically and electrically connected to a tab 116 (shown in FIG. 2) of the flex circuit 102. The tab 116 is defined by a portion of the flex circuit 102. The tab 116 may be provided along an edge of the flex circuit 102. The connector may have a low profile so that the connector 104 does not detrimentally affect the lighting of the LEDs 110.

Figure 2:
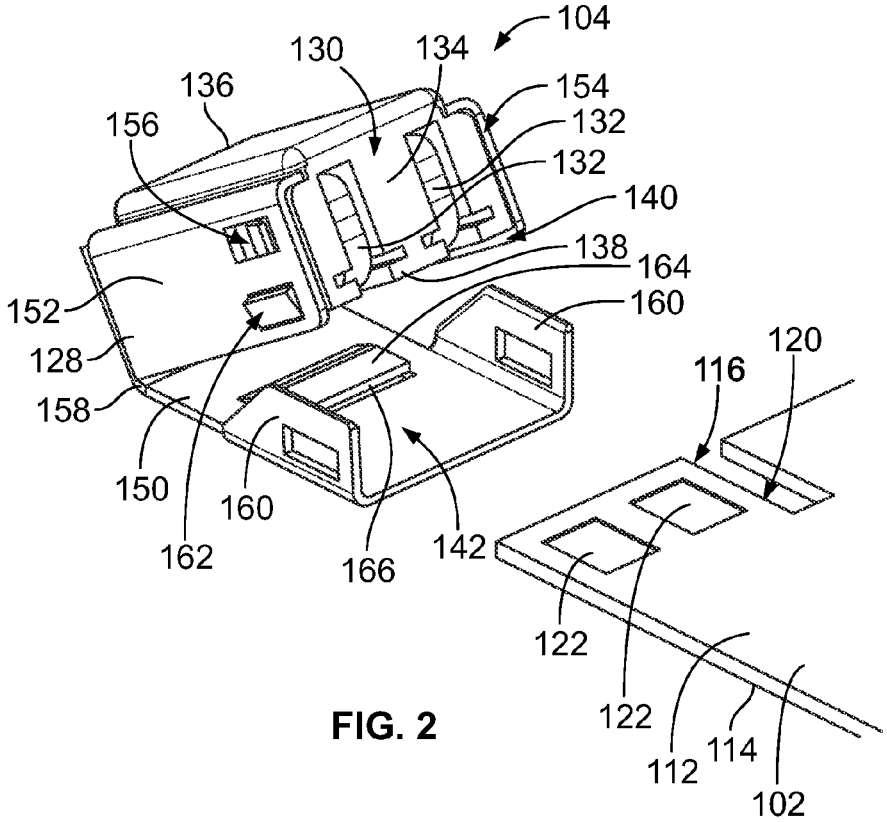
FIG. 2 is a front perspective view of the flexible circuit board connector poised for coupling to a flexible circuit board.

FIG. 2 is a front perspective view of the flexible circuit board connector 104 formed in accordance with an exemplary embodiment and poised for coupling to the flexible circuit board 102. The connector 104 is shown in an open state or position, as opposed to the closed state or position shown in FIG. 1. When open, the connector 104 may be easily positioned on or removed from the tab 116. When closed, the connector 104 is mechanically secured to the tab 116.

The tab 116 is arranged at an edge of the flexible circuit board 102, however the tab may be located at other positions, including an interior location of the flexible circuit board 102. One or more slots 120 may be formed through the flexible circuit board 102 to define the tab 116. Portions of the connector 104 may extend through the slot(s) 120. Contact pads 122 are provided along the tab 116. In the illustrated embodiment, the contact pads 122 are provided along the front side 112; however the contact pads may be along the rear side 114. The contact pads 122 are electrically connected to traces of the flexible circuit board 102 and are routed to the LEDs 110 (shown in FIG. 1). The connector 104 is configured to be electrically connected to the contact pads 122 to transfer the power from the wires 106 to the flexible circuit board 102. The contact pads 122 define separable mating interfaces for the connector 104.

The connector 104 includes a clip 128, a housing 130 held by the clip 128 and one or more contacts 132 that directly connect the wires 106 with corresponding contact pads 122. In the illustrated embodiment, the contacts 132 are poke-in contacts, and may be referred to hereinafter as poke-in contacts 132, however other types of contacts may be used in alternative embodiments, such as crimp contacts, insulation displacement contacts, and the like.

In an exemplary embodiment, the housing 130 includes and/or is formed from a dielectric material, such as a plastic material. The housing 130 includes a main body 134 that holds the contacts 132. The main body 134 extends from a top 136 to a bottom 138. The bottom 138 may face the flex circuit 102. Optionally, when the connector 104 is coupled to the flex circuit 102, the bottom 138 may be pressed against the flex circuit 102. The contacts 132 are exposed along the bottom 138 and engage the contact pads 122 when the housing 130 is pressed against the flex circuit 102. Optionally, the housing 130 may include a pocket 140 at the bottom 138 that receives the tab 116. The contacts 132 may extend at least partially into the pocket 140 to engage the contact pads 122 when the connector 104 is closed and coupled to the flex circuit 102.

The clip 128 is used to couple the housing 130 to the flex circuit 102. In the illustrated embodiment, the clip 128 is metal, however the clip may be manufactured from other materials, including a plastic material similar to the material of the housing 130. In an exemplary embodiment, the flex circuit 102 is configured to be captured between the clip 128 and the housing 130. For example, an intermediate space 142 is defined between the clip 128 and the main body 134, such as the bottom 138 of the main body 134. When the connector 104 is open, the intermediate space 142 is large and the flex circuit 102 is easily loaded into or removed from the intermediate space 142. As the connector 104 is closed, the intermediate space 142 shrinks until the flex circuit substantially or entirely fills the intermediate space 142. The clip 128 and housing 130 capture the flex circuit 102 in the intermediate space 142 when the clip 128 and/or housing 130 is in the closed position.

The clip 128 includes a base 150 and a cover 152. The intermediate space 142 is defined between the base 150 and the bottom 138 of the main body 134 of the housing 130. The flex circuit 102 is captured between the base 150 and the main body 134. The cover 152 defines a receptacle 154 that receives the housing 130. Optionally, latches 156 are provided to secure the housing 130 in the cover 152. As the cover 152 is coupled to the base 150, the cover 152 presses the main body 134 toward the base 150 to capture the flex circuit 102 in the intermediate space 142. For example, the cover 152 may be rotated closed. In an exemplary embodiment, the cover 152 is hingedly coupled to the base 150 at a hinge 158. Alternatively, the cover 152 may be separate from the base 150 and coupled thereto during assembly of the connector 104.

The base 150 includes side walls 160. The side walls 160 may extend through the flex circuit 102, such as through corresponding slots 120. The side walls 160 are coupled to the cover 152 to secure the cover 152 in a closed position (shown in FIG. 1) to the base 150. The cover 152 includes latches 162 that engage the side walls 160 to secure the cover 152 to the base 150. Alternatively, the base 150 may include the latches rather than the cover 152.

In an exemplary embodiment, the base 150 includes a stop tab 164. The stop tab 164 has an edge 166 defining a stop surface for locating the base 150, and thus the connector 104, relative to the flex circuit 102. For example, the connector 104 is loaded onto the tab 116 until the stop tab 164 engages an edge 168 of the tab 116. The stop tab 164 locates the connector 104 relative to the flex circuit 102 to align the contacts 132 with the contact pads 122.

Figure 3:
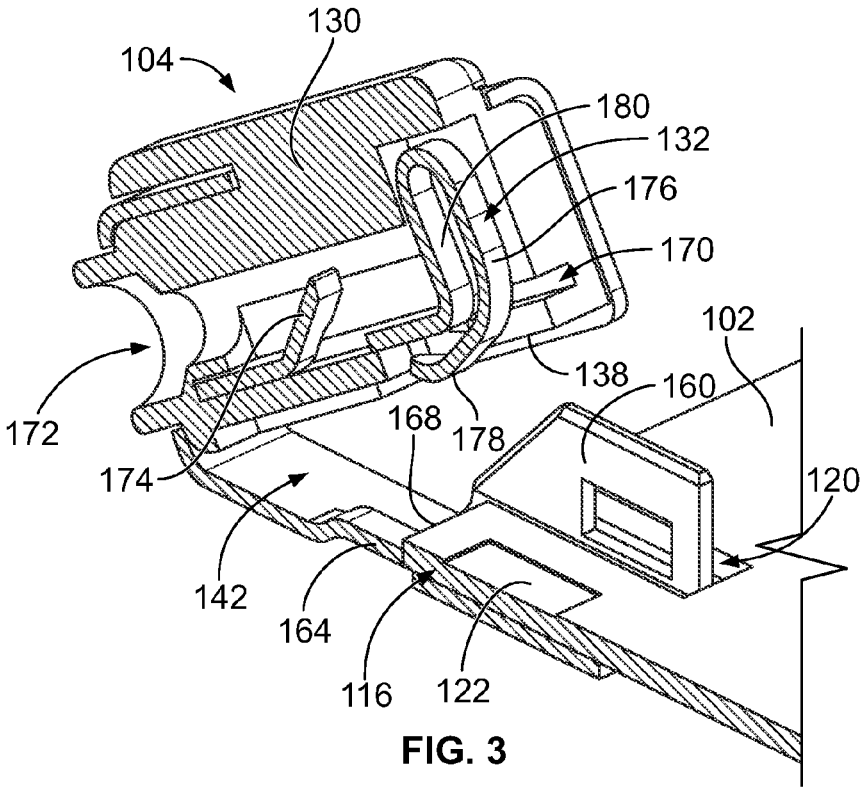
FIG. 3 is a partial sectional view of the flexible circuit board connector and flexible circuit board.

FIG. 3 is a partial sectional view of the flexible circuit board connector 104 and flexible circuit board 102. The connector 104 is shown in an open position. The connector 104 is positioned relative to the flex circuit 102 such that the tab 116 is within the intermediate space 142. The stop tab 164 abuts against the edge 168 to position the connector 104 relative to the flex circuit 102. Optionally, the side wall 160 is received in the corresponding slot 120 to locate the connector 104 relative to the flex circuit 102. For example, the side wall 160 may control side-to-side and/or forward positioning of the connector 104 relative to the flex circuit 102.

The contact 132 is received in a corresponding contact channel 170 of the housing 130. In an exemplary embodiment, the contact channel 170 extends entirely through the housing 130 and is open at the front and the bottom 138 of the housing 130. The contact channel 170 receives the poke-in contact 132 through the front. The contact channel 170 is open to a corresponding wire barrel 172 at the rear of the housing 130. The wire barrel 172 receives the corresponding wire 106 (shown in FIG. 1) and guides the wire 106 into the contact channel 170. The contact channel 170 is sized and shaped to hold the poke-in contact 132. The contact channel 170 is sized and shaped to receive and guide the wire 106 to the poke-in contact 132.

The poke-in contact 132 includes a wire trap defined by one or more lances 174 that mechanically and electrically connect to the wire 106. The lance 174 is deflectable and may dig into the conductor of the wire 106 to stop the wire from backing out of the housing 130. The lance 174 is electrically connected to the conductor to create an electrical path between the wire 106 and the contact 132. Other types of wire traps or securing features may be used in alternative embodiments to electrically connect the contact 132 to the wire 106. The contact 132 includes a spring beam 176 having a separable mating interface 178. The spring beam 176 is deflectable and is configured to be resiliently deflected against the contact pad 122 to create an electrical path between the contact 132 and the contact pad 122. In an exemplary embodiment, the spring beam 176 follows a tortuous path within the housing 130 to provide a long working length for the spring beam 176 to ensure that the spring beam 176 remains spring biased against the contact pad 122. Optionally, the spring beam 176 may have a blocking portion 180 forward of the wire barrel 172. The blocking portion 180 stops wire insertion into the housing 130. For example, the wire 106 may be inserted into the housing 130 until the wire 106 bottoms out against the blocking portion 180. The contact 132 may have other shapes or features in alternative embodiments.

Figure 4:
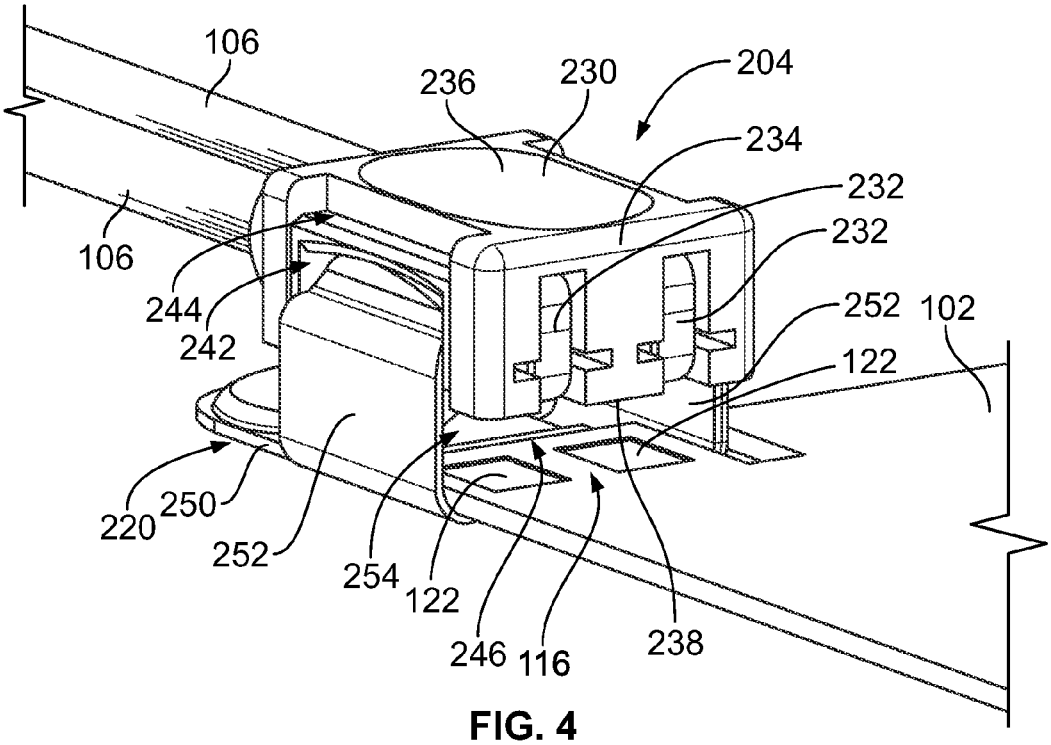
FIG. 4 illustrates a flexible circuit board connector formed in accordance with an exemplary embodiment.
Figure 5:
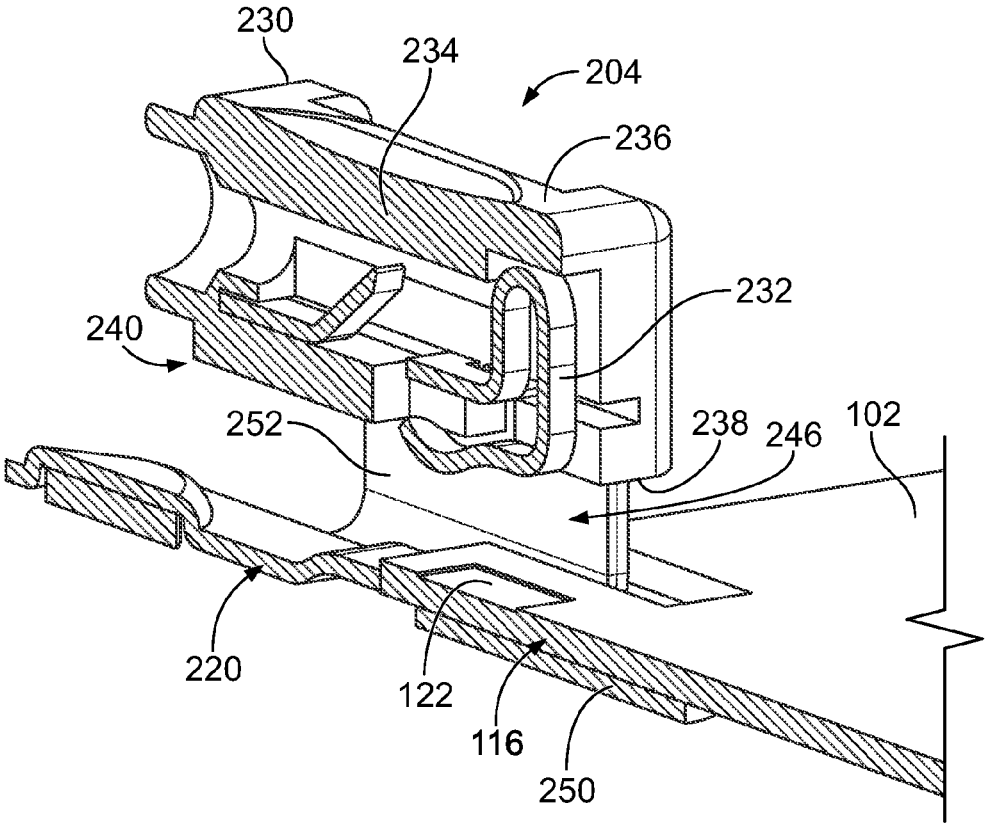
FIG. 5 is a cross-sectional view of the connector and flexible circuit board shown in FIG. 4.

FIG. 4 illustrates a flexible circuit board connector 204 formed in accordance with an exemplary embodiment. FIG. 5 is a cross-sectional view of the connector 204 and flexible circuit board 102. The connector 204 is similar to the connector 104 (shown in FIG. 2), however the connector 204 is secured to the flex circuit 102 in a different manner. The connector 204 is shown in an open state or position, and may be moved to a closed state or position where the connector is mechanically and electrically connected to the flex circuit 102. When open, the connector 204 may be easily positioned on or removed from the tab 116.

The connector 204 includes a clip 220, a housing 230 held by the clip 220 and one or more contacts 232 that directly connect the wires 106 with corresponding contact pads 122. Optionally, the contacts 232 may be identical to the contacts 132 (shown in FIG. 3). The contact 232 may be a poke-in contact having a wire trap that mechanically and electrically connect to the wire 106 (shown in FIG. 1). The contact 232 provides the direct electrical path between the wire 106 and the contact pad 122.

The housing 230 includes a main body 234 that holds the contacts 232. The main body 234 extends from a top 236 to a bottom 238. The bottom 238 may face the flex circuit 102. When the connector 204 is closed, the bottom 238 is pressed against the flex circuit 102. The contacts 232 are exposed along the bottom 238 and engage the contact pads 122 when the housing 230 is pressed against the flex circuit 102. Optionally, the housing 230 may include a pocket 240 at the bottom 238 that receives the tab 116. The contacts 232 may extend at least partially into the pocket 240 to engage the contact pads 122 when the connector 204 is closed and coupled to the flex circuit 102. The housing 230 includes lower grooves 242 and upper grooves 244. The clip 220 is coupled to the housing 230 by locating the clip 220 in either the lower grooves 242 (open or pre-staged position) or the upper grooves 244 (closed position).

The clip 220 is used to couple the housing 230 to the flex circuit 102. In the illustrated embodiment, the clip 220 is metal, however the clip may be manufactured from other materials, including a plastic material similar to the material of the housing 230. In an exemplary embodiment, the flex circuit 102 is configured to be captured between the clip 220 and the housing 230. For example, an intermediate space 246 is defined between the clip 220 and the main body 234, such as the bottom 238 of the main body 234. As the connector 204 is closed by pressing the housing 230 and clip 220 together, the intermediate space 246 shrinks until the flex circuit 102 substantially or entirely fills the intermediate space 246. The clip 220 and housing 230 capture the flex circuit 102 in the intermediate space 246 when the connector 204 is in the closed position.

The clip 220 includes a base 250 and latching beams 252 extending from the base 250. The latching beams 252 define a receptacle 254 therebetween that receives the housing 230. The latching beams 252 are used to secure the clip 220 to the housing 230. The latching beams 252 are received in and/or coupled to either the lower grooves 242 or the upper grooves 244. When in the lower grooves 242, the housing 230 is held in a pre-staged or open position. The relative positions of the clip 220 and housing 230 are fixed, however the intermediate space 246, between the base 250 and the bottom 238 of the main body 234 of the housing 230, is open to easily receive the tab 116 or to easily remove the tab 116 from the intermediate space 246. As the connector 204 is closed, the housing 230 is pushed further onto the clip 220 and/or the clip 220 is pushed further onto the housing 230 to move the latching beams 252 to the upper grooves 244. When the latching beams 252 are received in the upper grooves 244, the connector 204 is closed.

Figure 6:
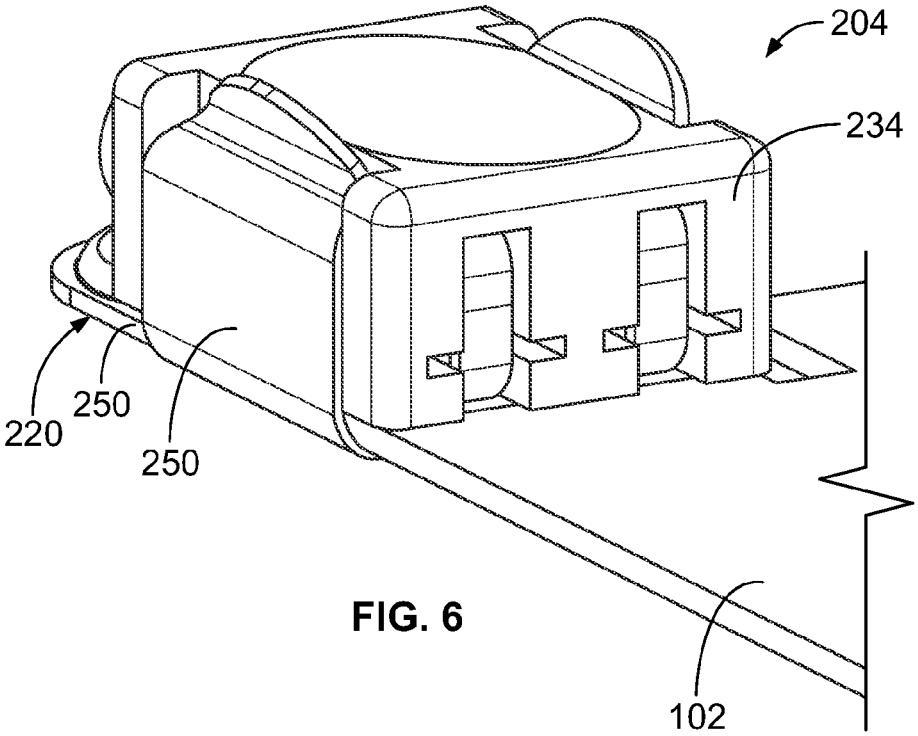
FIG. 6 is a top perspective view of the connector shown in FIG. 4 coupled to the flexible circuit board in a closed position.
Figure 7:
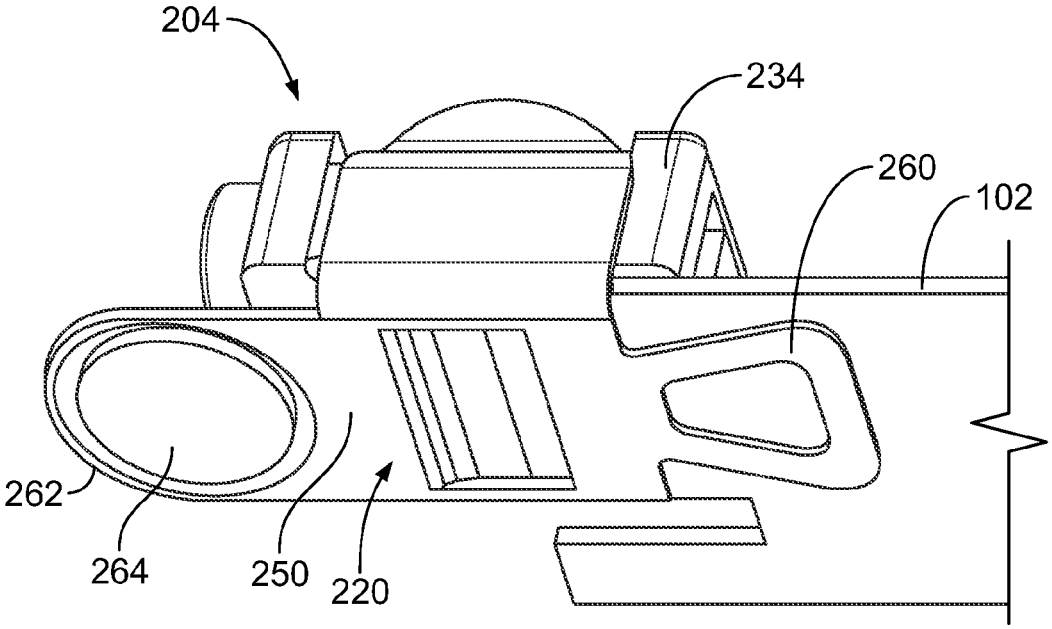
FIG. 7 is a bottom perspective view of the connector shown in FIG. 4 coupled to the flexible circuit board.

FIG. 6 is a top perspective view of the connector 204 coupled to the flex circuit 102 in a closed position. FIG. 7 is a bottom perspective view of the connector 204 coupled to the flex circuit 102. The flex circuit 102 is captured between the base 250 and the main body 234 in the closed position.

In an exemplary embodiment, the base 250 includes a mounting tab 260 extending forward from the base 250 and a mounting tab 262 extending rearward from the base 250. The forward mounting tab 260 is configured to extend along the flex circuit 102. The forward mounting tab 260 may support a portion of the flex circuit 102. The forward mounting tab 260 may be positioned between the flex circuit 102 and the mounting surface 108 (shown in FIG. 1). Optionally, the adhesive layer, such as double sided tape, may secure the clip 220 to the flex circuit 102. The forward mounting tab 260 may be positioned between the adhesive layer and the flex circuit 102, or alternatively, may be positioned between the adhesive layer and the mounting surface 108. The rearward mounting tab 262 may provide stability for the clip 220. The rearward mounting tab 262 may be mounted to the mounting surface 108. Optionally, the rearward mounting tab 262 may be secured to the mounting surface 108, such as by using an adhesive pad 264, a fastener (not shown), or by other means.

Figure 8:
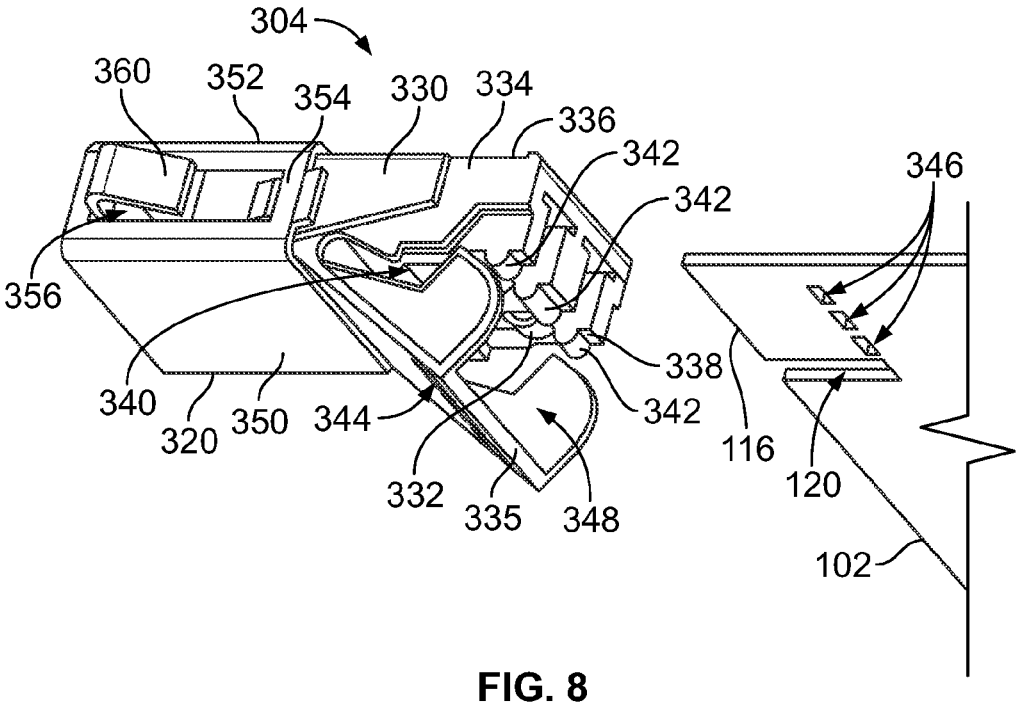
FIG. 8 illustrates a flexible circuit board connector formed in accordance with an exemplary embodiment.
Figure 9:
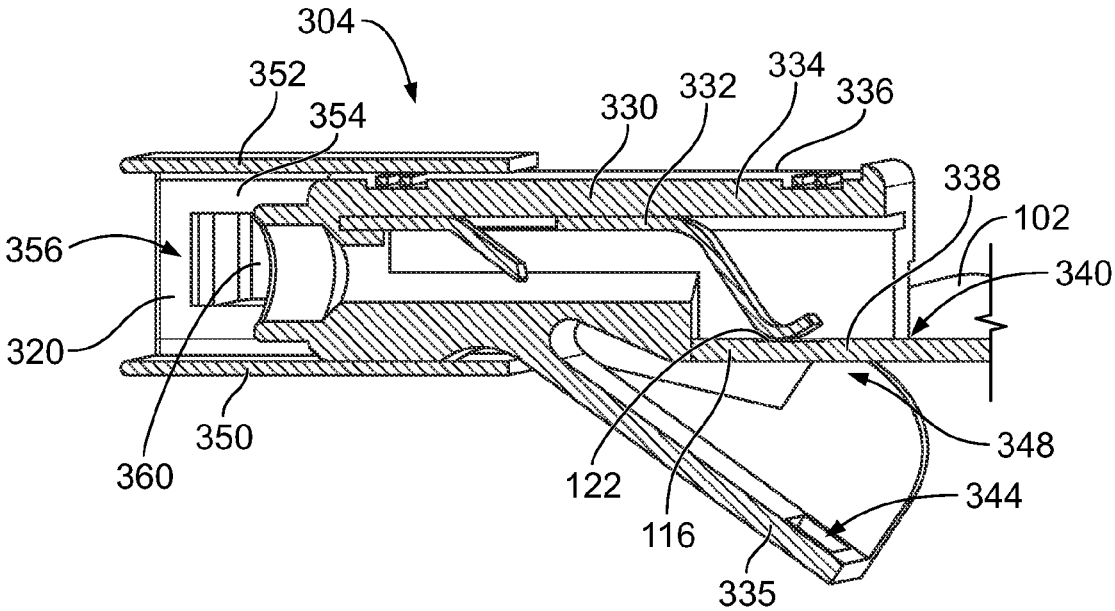
FIG. 9 is a cross-sectional view of the connector shown in FIG. 8 and flexible circuit board.

FIG. 8 illustrates a flexible circuit board connector 304 formed in accordance with an exemplary embodiment. FIG. 9 is a cross-sectional view of the connector 304 and flexible circuit board 102. The connector 304 is similar to the connectors 104 (shown in FIG. 3) and 204 (shown in FIG. 4), however the connector 304 is secured to the flex circuit 102 in a different manner. The connector 304 is shown in an open state or position, and may be moved to a closed state or position where the connector 304 is mechanically and electrically connected to the flex circuit 102. When open, the connector 304 may be easily positioned on or removed from the tab 116.

The connector 304 includes a clip 320, a housing 330 held by the clip 320 and one or more contacts 332 that directly connect the wires 106 with corresponding contact pads 122. The contact 332 may be a poke-in contact having a wire trap that mechanically and electrically connect to the wire 106 (shown in FIG. 1). The contact 332 provides the direct electrical path between the wire 106 and the contact pad 122.

The housing 330 includes a main body 334 that holds the contacts 332. The main body 334 defines a cap, and may be referred to hereinafter as a cap 334. The housing 330 also includes a base 335 that cooperates with the cap 334 to capture the tab 116. The main body 334 extends from a top 336 to a bottom 338. The bottom 338 may face the flex circuit 102. Optionally, the base 335 may be formed integral with and extend from the cap 334. For example, the base 335 may be connected to the cap 334 at the bottom 338 by a living hinge. Alternatively, the base 335 may be separate from the cap 334 and coupled thereto during assembly.

When the connector 304 is closed, the bottom 338 is pressed against the top of the flex circuit 102 and the base 335 is pressed against the bottom of the flex circuit 102. Optionally, portions of the base 335 may extend through the flex circuit 102 to engage the cap 334. The contacts 332 are exposed along the bottom 338 and engage the contact pads 122 when the housing 330 is pressed against the flex circuit 102. Optionally, the housing 330 may include a pocket 340 at the bottom 338 that receives the tab 116. The contacts 332 may extend at least partially into the pocket 340 to engage the contact pads 122 when the connector 304 is closed and coupled to the flex circuit 102.

In an exemplary embodiment, the cap 334 includes fingers 342 that are aligned with windows 344 in the base 335. When the connector 304 is closed, the fingers 342 may press into the windows 344. Optionally, the fingers 342 may press part of the flex circuit 102 into the windows 344 to secure the housing 330 to the flex circuit 102. For example, the flex circuit 102 may be held in the windows 344 by an interference fit. Optionally, the flex circuit 102 may include slots 346 aligned with the fingers 342 and windows 344. The fingers 342 may pass through the slots 346 into the windows 344. The connector 304 may be secured to the flex circuit 102 when the fingers 342 pass through the flex circuit 102.

The clip 320 is used to couple the housing 330 to the flex circuit 102. Optionally, the clip 320 may be used to hold the base 335 in a closed position. Optionally, the clip 320 may be used to close the base 335. For example, as the clip 320 is pressed forward onto the housing 330, the clip 320 may engage the base 335 and force the base 335 to close as the clip 320 is pressed further forward.

In the illustrated embodiment, the clip 320 is metal, however the clip 320 may be manufactured from other materials, including a plastic material similar to the material of the housing 330. In an exemplary embodiment, the flex circuit 102 is configured to be captured between the clip 320 and the main body 334. For example, when the clip 320 is pressed forward, an intermediate space 348 is defined between a bottom wall of the clip 320 and the main body 334, such as the bottom 338 of the main body 334. The base 335 and the flex circuit 102 are positioned in the intermediate space 348. While the clip 320 does not directly contact the flex circuit 102, the clip 320 is used to press the base 335 against the flex circuit 102 and capture the flex circuit 102 between the base 335 and the cap 334. The clip 320 and housing 330 capture the flex circuit 102 in the intermediate space 348 when the connector 304 is in the closed position.

The clip 320 includes a base 350 and a cover 352 with side walls 354 therebetween. The intermediate space 348 is defined between the base 350 and the bottom 338 of the main body 334 of the housing 330. The clip 320 defines a receptacle 356 that receives the housing 330. The side walls 354 may extend through the flex circuit 102, such as through corresponding slots 120. The side walls 354 include push tabs 360 for moving the clip 320 forward or rearward.

Figure 10:
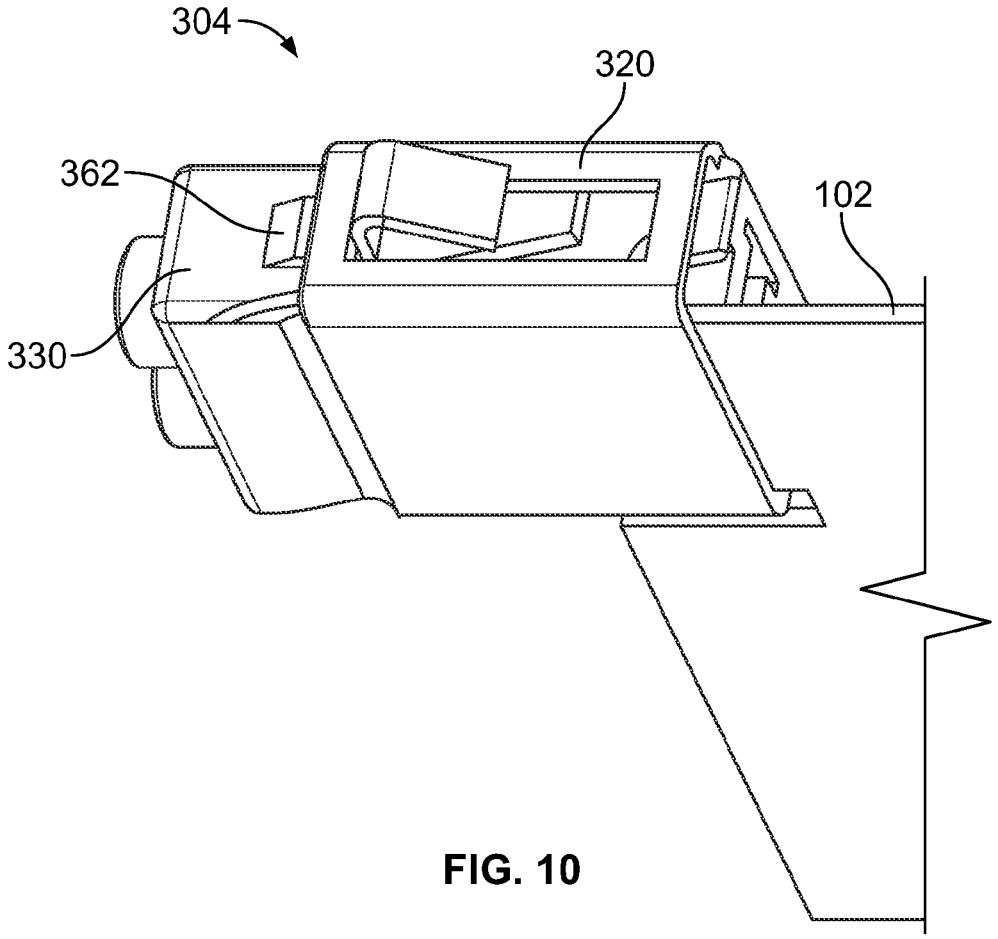
FIG. 10 is a bottom perspective view of the connector shown in FIG. 8 coupled to the flexible circuit board.

FIG. 10 is a bottom perspective view of the connector 304 coupled to the flex circuit 102. The connector 304 is in a closed state. The base 335 (shown in FIG. 8) is closed and the clip 320 is pushed forward to a closed position. A latch 362 extends from the housing 330 and is used to lock the connector 304 in the closed position. The latch 362 engages the clip 320 to stop the clip 320 from moving rearward to an open position. Other types of securing features may be provided in alternative embodiments to lock the connector 304.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A flexible circuit board connector comprising:

a contact having a mating end and a terminating end, the mating end having a spring beam having a separable mating interface configured to be surface mounted to a contact pad of a flexible circuit board, the terminating end being configured to be terminated to a wire;

a housing holding the contact, the housing having a main body including a contact channel holding the contact and a wire barrel configured to receive the wire, the main body being positionable above the flexible circuit board such that the contact is aligned with the contact pad; and a clip coupled to the housing with an intermediate space between the clip and the main body, the clip being movable between an open position and a closed position;

wherein the intermediate space is configured to receive the flexible circuit board when the clip is in the open position, and wherein the clip and housing are configured to capture the flexible circuit board when the clip is in the closed position, the spring beam being configured to be electrically connected to the contact pad when the clip is in the closed position, the housing being pressed against the flexible circuit board as the clip is moved to the closed position and the contact being compressed against the contact pad as the clip is moved to the closed position.

2. The flexible circuit board connector of claim 1, wherein the contact defines a direct electrical path between the wire and the contact pad of the flexible circuit board.

3. The flexible circuit board connector of claim 1, wherein the contact comprises a poke-in contact having a lance that mechanically and electrically connects to the wire.

4. The flexible circuit board connector of claim 1, wherein the clip includes a base, the intermediate space being defined between the base and a bottom of the main body of the housing, the clip engaging the main body and pressing the main body toward the base to capture the flexible circuit board in the intermediate space.

5. The flexible circuit board connector of claim 1, wherein the clip includes a base and a cover, the housing being received in the cover, at least one of the base or the cover comprising latches to secure the base to the cover with the flexible circuit board captured between the main body and the base.

6. The flexible circuit board connector of claim 5, wherein the cover is hingedly coupled to the base at a hinge.

7. The flexible circuit board connector of claim 1, wherein the clip includes a base and latching beams extending from the base, the latching beams latchably engaging the housing to secure the housing to the clip.

8. The flexible circuit board connector of claim 7, wherein the housing includes lower grooves and upper grooves, when the latching beams are received in the lower grooves the latching beams hold the housing in a pre-staged position wherein the flexible circuit board is configured to be unobstructedly received in the intermediate space, when the latching beams are received in the upper groves the latching beams press the housing against the flexible circuit board to electrically connect the contact to the contact pad of the flexible circuit board.

9. The flexible circuit board connector of claim 1, wherein the housing includes a cap and a base hingedly coupled to the cap, the cap being closed to capture the flexible circuit board between the cap and the base.

10. The flexible circuit board connector of claim 9, wherein the clip is slidably coupled to the housing, the clip being slid forward to the closed position to secure the base in a closed position.

11. The flexible circuit board connector of claim 1, wherein the clip includes a mounting tab extending therefrom, the mounting tab being configured to be secured to a mounting surface.

12. The flexible circuit board connector of claim 11, wherein the mounting tab extends along the flexible circuit board.

13. The flexible circuit board connector of claim 1, wherein at least one of the housing or the clip includes fingers configured to extend through the flexible circuit board to secure the flexible circuit board connector to the flexible circuit board.

14. A flexible circuit board connector system comprising:

a flexible circuit board having a front side and a rear side, the rear side being configured to be mounted to a mounting surface, the front side having a contact pad, the flexible circuit board having an LED terminated to the front side and electrically connected to the contact pad; and a flexible circuit board connector coupled directly to the flexible circuit board, the flexible circuit board connector comprising:

a contact having a mating end and a terminating end, the mating end having a spring beam having a separable mating interface surface mounted to the contact pad of the flexible circuit board, the terminating end being terminated to a wire;

a housing holding the contact, the housing having a main body including a contact channel holding the contact and a wire barrel that receives the wire, the main body having a bottom, the main body positioned above the flexible circuit board such that the bottom engages the flexible circuit and the contact engages the contact pad; and a clip coupled to the housing with an intermediate space between the clip and the main body, the flexible circuit board being held in the intermediate space, the clip being movable between an open position and a closed position;

wherein the intermediate space is configured to receive the flexible circuit board when the clip is in the open position, and wherein the clip and housing are configured to capture the flexible circuit board when the clip is in the closed position, the spring beam being configured to be electrically connected to the contact pad when the clip is in the closed position, the housing being pressed against the flexible circuit board as the clip is moved to the closed position and the contact being compressed against the contact pad as the clip is moved to the closed position.

15. The flexible circuit board connector system of claim 14, wherein the clip and the housing capture the flexible circuit board therebetween.

16. The flexible circuit board connector system of claim 14, wherein the contact defines a direct electrical path between the wire and the contact pad of the flexible circuit board.

17. The flexible circuit board connector system of claim 14, wherein the contact comprises a poke-in contact having a lance that mechanically and electrically connects to the wire.

18. The flexible circuit board connector system of claim 14, wherein the housing is pressed against the flexible circuit board and the contact is compressed against the contact pad and held there by the clip when the clip is in the closed position.

19. The flexible circuit board connector system of claim 14, wherein the clip includes a base, the base engaging the rear side of the flexible circuit board and compressing the flexible circuit board between the base and the bottom of the main body of the housing.

* * * * *